United States Patent [19]

Pollet et al.

[11] 4,111,697

[45] Sep. 5, 1978

[54] NOVEL ANTIFOGGING AND/OR STABILIZING COMPOUNDS FOR SILVER HALIDE PHOTOGRAPHY

[75] Inventors: Robert Joseph Pollet, Vremde; Antoon Leon Vandenberghe, Hove; Valére Frans Danckaert, Boechout; Jozef Frans Willems, Wilrijk; George Frans Van Veelen, Mortsel, all of Belgium

[73] Assignee: Agfa-Gevaert, N. V., Mortsel, Belgium

[21] Appl. No.: 776,432

[22] Filed: Mar. 10, 1977

[30] Foreign Application Priority Data

Mar. 29, 1976 [GB] United Kingdom ..... 12596/76

[51] Int. Cl.$^2$ ..... G03C 5/30; G03C 1/34

[52] U.S. Cl. ..... 96/66.5; 96/67; 96/76 R; 96/109

[58] Field of Search ..... 96/109, 66.5, 107, 95, 96/63, 76 R, 67

[56] References Cited

U.S. PATENT DOCUMENTS

| | | | |
|---|---|---|---|
| 2,819,965 | 1/1958 | Murray et al. | 96/109 |
| 2,897,081 | 7/1959 | Dersch et al. | 96/66.5 |
| 3,155,516 | 11/1964 | Blake | 96/107 |
| 3,554,750 | 1/1971 | König et al. | 96/95 |
| 3,689,273 | 9/1972 | Willems et al. | 96/109 |

FOREIGN PATENT DOCUMENTS

| | | | |
|---|---|---|---|
| 1,297,797 | 3/1970 | U.S.S.R. | 96/109 |

*Primary Examiner*—Won H. Louie, Jr.
*Attorney, Agent, or Firm*—A. W. Breiner

[57] ABSTRACT

Photographic silver halide material developed in the presence of a novel antifogging or stabilizing compound which is present in the material and/or in the developing composition and corresponds to the following formula:

wherein:

Q is sulphur or selenium

X is sulphur, selenium or oxygen

Y is sulphur, selenium, oxygen or a single bond, $R^1$ stands for an alkyl group having no nitrogen containing substituents or an aryl group, $R^2$ represents the same groups as indicated for $R^1$, provided that only when X represents sulphur or selenium nitrogen containing substituents of alkyl are excluded, $R^3$ stands for hydrogen, carboxy in acid or salt form, an alkyl group or an aryl group, and $R^4$ stands for hydrogen provided Y represents a single bond, an alkyl group having no nitrogen containing substituents, when Y represents sulphur or selenium and having no hydroxy substituents when Y represents a single bond and X as well as Q represent sulphur or selenium, or an aryl group, $R^3$ and $R^4$ may also form together an alkylene group provided Y is a single bond.

5 Claims, No Drawings

NOVEL ANTIFOGGING AND/OR STABILIZING COMPOUNDS FOR SILVER HALIDE PHOTOGRAPHY

This invention relates to silver halide photography and more particularly to the use of novel antifogging and/or stabilizing compounds in silver halide photography.

It is well known that light-sensitive silver halide materials comprising gelatin silver halide emulsion layers are subject to fogging. Fogging in general and chemical fogging in particular may be defined as the formation of a uniform deposit of silver on development which is dependent on a whole series of circumstances and factors namely on the nature of the emulsions, on their age, on the conditions under which they have been stored, on the development conditions, etc. For particular development conditions the fog tends to be higher when the time of storage and the temperature and relative humidity of the atmosphere in which the emulsions are stored are increased. Fog also increases with the degree of development and by rapid development at elevated temperatures.

A large variety of compounds have been described in the prior art for reducing fog formation in light-sensitive silver halide emulsions to stabilize the emulsions against fogformation. These compounds can be used more or less successfully dependent on many circumstances e.g. the type and composition of emulsion in which they are used and the processing conditions e.g. normal or elevated temperatures of the exposed emulsions. Therefore there is still a need for novel types of fog inhibitors.

It has been found that favourable antifogging and/or stabilizing effects are obtained in silver halide emulsions by using compounds corresponding to the following general formula

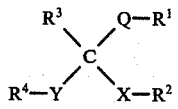

I wherein

Q represents sulphur or selenium,

X represents sulphur, selenium or oxygen,

Y represents sulphur, selenium, oxygen or a single bond, $R^1$ represents alkyl including substituted alkyl but excluding nitrogen containing substituents or aryl including substituted aryl; representative examples for $R^1$ are methyl, ethyl, propyl, butyl, tridecyl, sulphoalkyl or carboxyalkyl e.g. carboxymethyl, carboxyethyl, sulphopropyl, the carboxy or sulpho group being in acid or salt form, aralkyl e.g. phenylethyl, phenyl, alkaryl e.g. tolyl, halogen substituted phenyl e.g. chlorophenyl, dichlorophenyl, hydroxyphenyl, alkoxyphenyl e.g. methoxyphenyl, sulphophenyl and carboxyphenyl, the sulpho and carboxy groups being in acid or salt form, $R^2$ represents alkyl including substituted alkyl but if X represents sulphur or selenium excluding nitrogen containing substituents or aryl including substituted aryl; representative examples of alkyl and aryl groups for $R^2$ are the same as those given for $R^1$, $R^3$ represents hydrogen, carboxy in acid or salt form, alkyl including substituted alkyl or aryl including substituted aryl; representative examples of alkyl and aryl groups for $R^3$ are the same as those given for $R^1$, $R^4$ represents hydrogen provided Y represents a single bond, alkyl including substituted alkyl, but if Y represents sulphur or selenium excluding nitrogen containing substituents and if Y represents a single bond and X as well as Q represent sulphur or selenium excluding hydroxy substituents or aryl including substituted aryl; representative examples of alkyl and aryl groups for $R^4$ are the same as those given for $R^1$; $R^4$ may also form with $R^3$ an alkylene group e.g. pentamethylene provided Y is a single bond.

Preferred compounds of the above formula are those wherein each of $R^1$ and $R^2$ represents carboxy alkyl e.g. carboxy methyl and carboxy ethyl and X is sulphur or selenium.

Representative examples of compounds according to the above formula are listed in the table A.

Table A

| Compound | Structural formula | BP | MP | Lit. references or preparation |
|---|---|---|---|---|
| 1 | 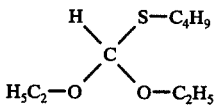 | 62° C at 0,1 mm Hg | | Bull.Soc.Chem. Fr. 327 (1969) |
| 2 | 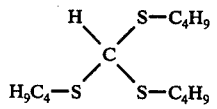 | 132–133° C at 0.07 mm Hg | | Bull.Soc.Chem. Fr. 327 (1969) |
| 3 | 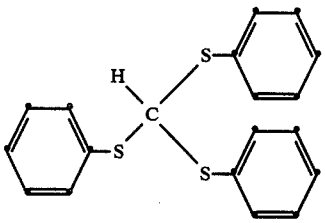 | | 40–40,4° C | Recueil des Trav.Chim. des Pays-Bas 81; 1018 (1962) |

Table A-continued
| Compound | Structural formula | BP | MP | Lit. references or preparation |
|---|---|---|---|---|
| 4 | 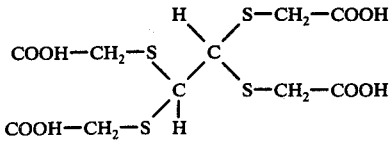 | | 192° C | J.Chem.Soc. (A) 797 (1970) |
| 5 | 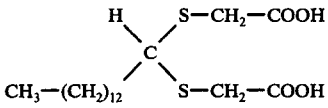 | | 82° C | Preparation 5 |
| 6 | 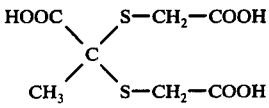 | | 168° C | Preparation 3 |
| 7 | 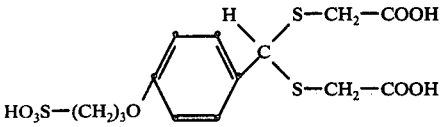 | | > 260° C | Preparation 13 |
| 8 | 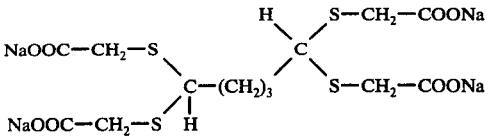 | | > 260° C | Preparation 8 |
| 9 | 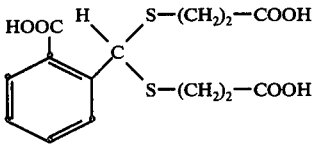 | | 150° C | Preparation 14 |
| 10 | 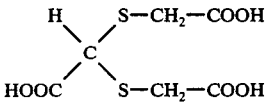 | | 162° C | Preparation 7 |
| 11 | 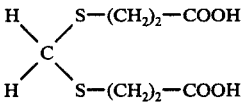 | | 142–143° C | Chem.Abr. 37,85[5] Arkiv Kem, mineral Geol. 15 A(8) 1–15 (1942) |
| 12 | 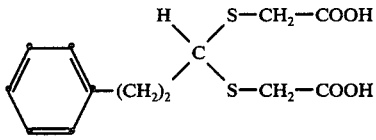 | | 105° C approx. | Preparation 6 |
| 13 | 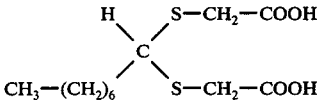 | | < 50° C | Preparation 4 |
| 14 | 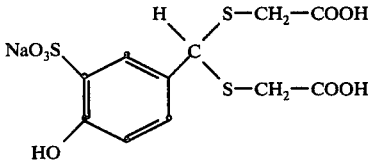 | | > 260° C | Preparation 12 |
| 15 | 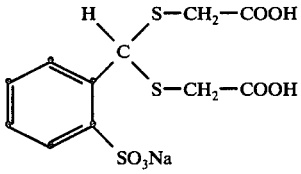 | | > 260° C | Preparation 11 |

Table A-continued
| Compound | Structural formula | BP | MP | Lit. references or preparation |
|---|---|---|---|---|
| 16 | 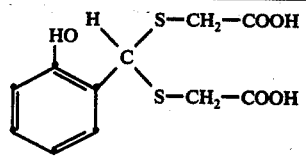 | | 150° C | Preparation 9 |
| 17 | 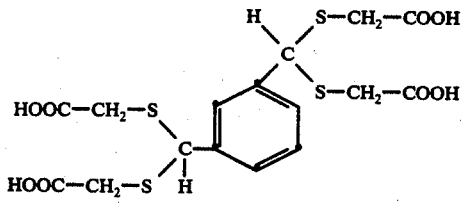 | | 195° C | J.Chem.Soc. (A) 797 (1970) |
| 18 | 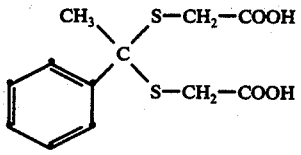 | | 140° C | Preparation 1 |
| 19 | 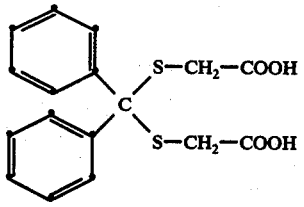 | | 192° C | Preparation 2 |
| 20 | 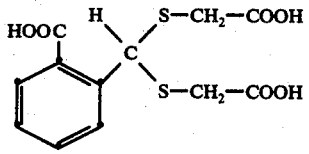 | | 220° C | Preparation 10 |
| 21 | 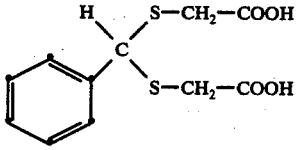 | | 103–104° C | J.Chem.Soc. 797 (1970) |
| 22 | 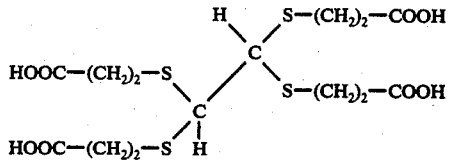 | | 162° C | J.Am.Chem.Soc. 74, 5577 (1952) |
| 23 | 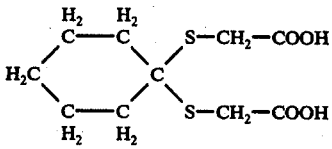 | | 140° | Tetrahedron 28 1931 (1972) |
| 24 | 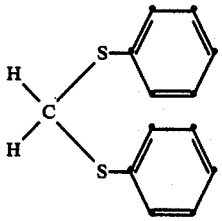 | 138° C at 0.1 mm Hg | | Angew.Chem. 81, 465 (1969) |
| 25 | 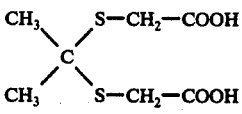 | | 126–127°C | Ber. 21, 482 (1888) |

Table A-continued

| Compound | Structural formula | BP | MP | Lit. references or preparation |
|---|---|---|---|---|
| 26 | 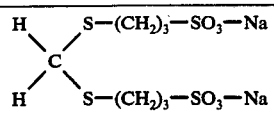 | | >260° C | Preparation 15 |

The compounds according to the above formula can be prepared according to the methods of the literature references given hereinbefore or according to the methods of the following preparations.

In the following preparations, most of the reactions of aldehydes and ketones with mercapto carboxylic acids are carried out analogously to the method described in J.Am.Chem. Soc. 74, 5576 (1952).

Preparation 1 — compound 18

55.2 g (0.6 mole) of thioglycolic acid were added to 36 g (0.3 mole) of acetophenone. Gaseous hydrogen chloride was introduced for 15 min in this mixture. The temperature of reaction mixture rose to 90°-95° C. Upon cooling compound 18 slowly crystallised. The reaction product was recrystallised from a mixture of water and ethanol. Yield: 54 g (63%), melting point: 140° C. Content of —COOH: 97%.

Preparation 2 — compound 19

36.8 g (0.4 mole) of thioglycolic acid were added to a solution of 36.4 g (0.2 mole) of benzophenone dissolved in 75 ml of dioxan. Gaseous hydrogen chloride was introduced for 15 min. The temperature of the reaction mixture rose to 75° C. whereupon the mixture was further heated for 4 hours on a boiling water bath. Upon cooling compound 19 crystallised slowly. It was recrystallised from a mixture of ethanol and water. Yield: 34 g (49%), melting point: 192° C. Content of —COOH: 98%.

Preparation 3—compound 6

92 g (1 mole) of thioglycolic acid were added to 44 g (0.5 mole) of pyruvic acid. Gaseous hydrogen chloride was introduced for 15 min. The temperature of the reaction mixture rose to 70° C. Upon cooling compound 6 crystallised out. The crystals were washed with benzene and the product was recrystallised from acetonitrile. Yield: 75 g (58%), melting point: 168° C. Nuclear magnetic resonance (NMR) confirmed the structure.

Preparation 4—compound 13

73.6 g (0.8 mole) of thioglycolic acid were added to 51.2 g (0.4 mole) of n-caprylic aldehyde dissolved in 50 ml of dioxan. Gaseous hydrogen chloride was introduced for 15 min. The reaction mixture rose to 85° C. and a viscous means was obtained, which after a few days become solid. The residue was sucked off and washed with dioxan. Yield: 104.5 g (88%), melting point: lower than 50° C. The structure was confirmed by NMR.

Preparation 5—compound 5

36.8 g (0.4 mole) of thioglycolic acid were added to 42.4 g (0.2 mole) of myristic aldehyde dissolved in 50 ml of dioxan. Gaseous hydrogen chloride was introduced for 15 min. The temperature of the reaction mixture rose to 75° C. An oily residue formed, which solidified after a few days. The residue was sucked off and washed with a mixture of dioxan and hexane. Yield: 29 g (38%), melting point: 82° C. The structure of compound 5 was confirmed by NMR.

Preparation 6—compound 12

92 g (1 mole) of thioglycolic acid were added to 67 g (0.5 mole) of 3-phenyl-propionic aldehyde. The temperature of the mixture was allowed to rise to 80° C. For 15 min. gaseous hydrogen chloride was introduced. The reaction mixture was kept for 6 hours on a boiling water-bath. After a few days the reaction mixture became solid and was washed with hexane. Yield: 134 g (88%), melting point approximately 105° C. The structure was confirmed by NMR. Content of S: calculated 21.35%; found 21.65-21.50%.

Preparation 7—compound 10

92 g (1 mole) of thioglycolic acid was added to 37 g (0.5 mole) of glyoxylic acid hydrate dissolved in 50 ml of water. Gaseous hydrogen chloride was introduced up to the saturation point. The temperature of the reaction mixture was allowed to rise to 70° C. and additional heat was supplied with stirring on a boiling water-bath. Up on cooling down compound 10 crystallised out. It was sucked off and washed with dioxan.

Yield: 105 g (87%), melting point: 162° C. Content of —COOH: 98%.

Preparation 8—compound 8

92 g (1 mole) of thioglycolic acid were added to 100 g of a 25% by weight glutaraldehyde solution (0.25 mole). Gaseous hydrogen chloride was introduced up to saturation. The temperature was allowed to rise to 75° C. During standing overnight an oily layer separated which was collected in ether. After washing of the ether extract with water, it was dried with sodium sulphate and the ether was evaporated. The viscous oily substance was suspended in water and neutralized with sodium hydrogen carbonate. The resulting solution was evaporated. Yield: 68 g (65%), melting point >260° C. Content of —COONa 91.4%, content of $H_2O$ 6.9%.

Preparation 9—compound 16

92 g (1 mole) of thioglycolic acid were added to 61 g (0.5 mole) of salicyl aldehyde dissolved in 75 ml of dioxan. Gaseous hydrogen chloride was introduced for 15 min. The temperature of the reaction mixture rose to 80° C. The reaction mixture became completely solid and was treated with water. The finally rubbed residue was recrystallised from water. Yield: 58 g (40%), melting point: 150° C. Content of —COOH 97%.

Preparation 10—compound 20

92 g (1 mole) of thioglycolic acid were added to 75 g (0.5 mole) of o-carboxybenzaldehyde suspended in 75 ml of dioxan. Gaseous hydrogen chloride was introduced for 15 min. The temperature rose to 80° C. First a solution was obtained. Subsequently, the reaction product crystallised out. Upon cooling the residue was sucked off and washed with water. The residue was recrystallised from a mixture of ethanol and water. Yield: 104 g (65%), melting point: 220° C. —COOH content: 100%.

Preparation 11—compound 15

92 g (1 mole) of thioglycolic acid were added to 104 g (0.5 mole) of the sodium salt of benzaldehyde-o-sulphonic acid. Gaseous hydrogen chloride was introduced up to saturation. The temperature rose to 80° C. A solution was first obtained. The reaction mixture crystallised out partially. After two days at room temperature the residue was rubbed fine and sucked off as dry as possible. The residue was recrystallised from water. Yield: 110 g (59%), melting point >260° C.

According to NMR the structure of compound 15 was confirmed. S-content: calculated: 25.65% found: 24.90–24.95%

Preparation 12—compound 14

73.6 g (0.8 mole) of thioglycolic acid were added to 89.6 g (0.4 mole) of the sodium salt of p-hydroxy benzaldehyde-m-sulphonic acid suspended in 60 ml of water. Gaseous hydrogen chloride was introduced up to saturation. The temperature rose to 85° C. Initially a partial solution was obtained, whereupon the reaction product crystallised out. After having been kept for 2 days at ambient temperature the residue was sucked off and washed with a minimum amount of water. Yield: 26 g (17%), melting point: 260° C. The structure was confirmed by NMR.

S-content: calculated: 24.60% found: 23.65–23.90%

Preparation 13—compound 7

(a) Synthesis of the sodium salt of p-sulphopropyloxy benzaldehyde 61 g (0.5 mole) propane sultone were added to 72 g (0.5 mole) of the sodium salt of p-hydroxy benzaldehyde suspended in 1 l of dimethylformamide. The reaction mixture was heated with stirring at 150° C. for 6 hours and evaporated in a rotating evaporation apparatus. The residue was reboiled in a mixture of acetone and ether and was sucked off. Yield: 104 g (78%), melting point: 236° C. The structure of the compound was confirmed with NMR.

(b) Actual synthesis of compound 7

36.8 g (0.4 mole) of thioglycolic acid were added to 53.2 g (0.2 mole) of the sodium salt of p-sulphopropyloxy benzaldehyde suspended in 50 ml of water. Gaseous hydrogen chloride was added up to saturation. The temperature rose to 85° C. After standing overnight the sodium chloride was sucked off. After a few days the reaction mixture became solid. The residue was sucked off and dried. Yield: 44 g (53%), melting point >260° C. The structure of compound 7 was confirmed by NMR. Content of free sulphonic acid: 93%. —COOH content: 98%.

Preparation 14—compound 9

106 g (1 mole) of β-mercapto propionic acid were added to 75 g (0.5 mole) of o-carboxy benzaldehyde suspended in 75 ml of dioxan. Gaseous hydrogen chloride was introduced for 15 min. Initially a solution was obtained and the reaction mixture crystallised out. Upon cooling the residue was treated with water and sucked off. The residue was recrystallised from a mixture of water and ethanol.

Yield: 137 g (79%), melting point 156° C. —COOH content: 98.5%.

Preparation 15 —compound 26

(a) synthesis of the sodium salt of S-acetyl-γ-mercaptopropanesulphonic acid 76 g (1 mole) of thio-acetic acid were added dropwise at ambient temperature to 54 g (1 mole) of sodium methylate dissolved in 1 l of water.

Thereafter 122 g (1 mole) of freshly distilled propane sultone were added in small portions, during which the temperature of the reaction mixture rose to 30° C. A white residue formed. Stirring was continued for 1 hour and the reaction mixture was allowed to stand overnight. By the addition of ether there was obtained complete precipitation. The residue was sucked off and dried in vacuum.

Yield: 176 g (80%), melting point: approximately 220° C. NMR confirmed the structure.

(b) synthesis of compound 26

7.5 g of formaldehyde 40% (0.1 mole) were added to 44 g (0.2 mole) of the sodium salt of S-acetyl-γ-mercapto propane sulphonic acid suspended in 100 ml of dioxan. Gaseous hydrogen chloride was added while stirring up to saturation. The temperature rose to 75° C. and a crystalline residue (sodium chloride) formed. This residue was dissolved in 250 ml of water and neutralised with 5N sodium hydroxide. After having been dried in a rotating evaporator, the residue was crystallized from a mixture of 125 ml of ethanol and water (7/3). Yield: 16 g (43%), melting point >260° C. NMR confirmed the structure.

The present invention thus provides a photographic material comprising a support and at least one light-sensitive emulsion layer wherein the emulsion layer and/or a hydrophilic colloid layer in water permeable relationship with the emulsion layer comprises a compound corresponding to the general formula I defined hereinbefore.

The antifoggants corresponding to the above formula may be incorporated in various types of light-sensitive emulsion e.g. in X-ray emulsions reprographic or graphic emulsions and emulsions intended for so-called amateur and professional photography, in continuous tone or high contrasty emulsions, in silver halide emulsions suited silver complex diffusion transfer processes, in non spectral sensitized emulsions as well as in spectrally sensitized emulsions. They may be incorporated in high speed as low speed, black and white emulsions and in colour emulsions.

Various silver salt may be used as light-sensitive salt e.g. silver bromide, silver iodide, silver chloride, or mixed silver halides e.g. silver chlorobromide, silver bromoiodide, or silver chlorobromoiodide.

The silver halides can be dispersed in the common hydrophilic colloids such as gelatin, casein, zein, polyvinyl alcohol, carboxymethyl cellulose, alginic acid, etc., gelatin being, however, favoured.

The amount of compound according to the present invention employed in the light-sensitive silver halide material may vary between wide limits and depends on each individual compound and material employed. Optimum amounts can easily be determined by routine experiments. Generally the amount varies from about 0.001 to about 10 mmoles, preferably from about 0.01 to about 5 millimoles per mole of silver halide. The way in which the antifoggants of use according to the invention are added to the emulsions is not critical and the addition can be made during no matter what step of emulsion preparation: they can be added before, during or after addition to the emulsion of spectral sensitizers, preferably just before coating of the emulsion on a suitable support such as for example paper, glass, film or metal laminated paper.

Instead of incorporating the antifoggants of the invention into the emulsion layer they can also be incorporated into another water-permeable colloid layer of the photographic material, e.g. a gelatin antistress layer or intermediate layer, which is in water-permeable relationship with the said emulsion layer. It is also possible to use the compounds at the processing stage by incorporating in one of the processing solutions e.g. in a developing solution (colour as well as black-and-white) for an exposed photographic material. When used in the developing solution they can also be used in widely varying amounts optimum amounts can easily be determined by tests, known to those skilled in the art.

Processing of photographic materials containing the antifoggants of the invention or with processing solutions containing the antifoggants may occur at room temperature or elevated temperature e.g. above 30° C.

The present invention thus also provides a process of inhibiting fog formation in photographic light-sensitive silver halide materials comprising a support coated with water permeable colloid layers including a light-sensitive silver halide emulsion layer which process comprises exposing the said material and developing it in the presence of a compound as defined in the general formula I, mentioned hereinbefore, which is present in the material or in the developing composition.

The silver halide emulsions used in accordance with the present invention may be chemically sensitized by effecting the ripening in the presence of small amounts of sulphur-containing compounds such as allyl thiocyanate, allyl thiourea, sodium thiosulphate, etc. The emulsions may also be chemically sensitized by means of reductors for instance tin compounds as described in British Pat. No. 789,823, and small amounts of noble metal compounds such as gold, platinum, palladium, iridium, ruthenium and rhodium compounds as described by R. Koslowsky, Z. Wiss. Phot., 46, 65–72 (1951).

The emulsions may be spectrally sensitized or not. It is advantageous to sensitize them spectrally according to methods well known in the art to make them orthosensitized or panchromatically sensitized. Spectral sensitizers that can be used are e.g. the cyanines, merocyanines, complex(trinuclear) cyanines, complex (trinuclear) merocyanines, styryl dyes, oxonol dyes and the like. Suchlike spectrally sensitizing dyes have been described by F. M. Hamer in "The Cyanine dyes and related Compounds" (1954).

The emulsions may be hardened in the conventional way e.g. by means of formaldehyde, halogen-substituted aldehydes e.g. mucochloric acid and mucobromic acid, glutaraldehyde, diketones, dioxan derivatives, aziridine, oxypolysaccharides, methansulphonic acid esters, etc.

Other conventional addenda may be added to the emulsions e.g. plasticizers, coating aids, hardening agents, antistaining agents, matting agents, developing agents, wetting agents, colour couplers, compounds that sensitize the emulsions by development acceleration, other fog-inhibitors and emulsion -stabilizing agents, etc.

Compounds that sensitize the emulsions by development acceleration are e.g. alkylene oxide polymers. These alkylene oxide polymers may be of various type e.g. polyethylene glycol having a molecular weight of 1500 or more, alkylene oxide condensation products or polymers as described among others in U.S. Pat. Nos. 1,970,578, 2,240,472, 2,423,549, 2,441,389, 2,531,832 and 2,533,990, in United Kingdom Patent Specification Nos. 920,637, 940,051, 945,340, 991,608 and 1,015,023 and in Belgian Patent Specification No. 648,710. Other compounds that sensitize the emulsion by development acceleration and that may be used in combination with the foregoing polymeric compounds are quaternary ammonium and phosphonium compounds and ternary sulphonium compounds as well as onium derivatives of amino-N-oxides as described in United Kingdom Patent Specification No. 1,121,696.

The emulsions may also comprise common antifoggants and emulsion stabilizers e.g. homopolar or salt-like compounds of mercury with aromatic and heterocyclic rings (e.g. mercaptotriazoles) simple mercury compounds, mercury sulphonium double salts and other mercury compounds of the kind described in Belgian Patent Specification Nos. 524,121, 677,337, 707,386, and 709,195, pyrimidine derivatives as described in DT-AS No. 1,294,188, aminothiazole derivatives combined with derivatives of azaindenes as described in DT-AS No. 1,209,426. Other suitable emulsion stabilizers are the azaindenes, particularly the tetra- or pentaazaindenes and especially those substituted by hydroxy- or amino groups. Suchlike compounds have been described by Birr in Z. Wiss. Phot. 47, 2–58 (1952). The emulsions may further comprise as stabilizers heterocyclic nitrogen-containing mercapto compounds such as benzothiazoline-2-thione and 1-phenyl-5-mercapto-tetrazole, which may comprise sulpho or carboyl groups, mercapto carboxylic derivatives of disulphides as described in U.S. Pat. No. 1,742,042 or derivatives of e.g. heterocyclic mercapto compounds, nitrobenzene compounds as described in G.B. Pat. No. 1,399,449, disulphides, sulphinic acids such as benzene sulphinic acid and toluene sulphinic acid, thiosulphinic acids such as benzene thiosulphonic acid, toluene thiosulphonic acid, p-chlorobenzene thiosulphonic acids sodium salt, propyl thiosulphonic acid potassium salt, butyl thiosulphonic acid, potassium salt, etc.

The following examples illustrate the fog-inhibiting and/or stabilizing action of the compounds corresponding to the above general formula.

EXAMPLE 1

To several series of aliquot portions of a photographic ammoniacal silver bromoiodide gelatin emulsion (4.7 mole % of iodide) comprising per kg an amount of silver halide equivalent to 50 g of silver nitrate one of the fog-inhibitors according to the invention was added as listed in table B hereinafter. The emulsion portions were coated on a conventional support and dried.

The sensitometric values obtained after exposure and processing of a strip of the freshly prepared materials and of a strip of the materials which was stored for 5 days at 57° C. and 34% relative humidity are listed in the table.

The values given for the speed are relative values corresponding to density 0.1 above fog; the speed of the fresh materials comprising no fog inhibitor of the invention (controls) is given the value 100. The values given for the fog are absolute values. The values given for $\gamma$ is the value of gradation measured from the characteristic curve over an exposure range of log It = 0.60 starting from a density value of 0.5 above fog.

Development occurred at 20° C. for 5 min in a developing solution having the following composition:

| | | |
|---|---|---|
| water | 800 | ccs |
| p-monomethylaminophenol sulphate | 1.5 | g |
| sodium sulphite (anhydrous) | 50 | g |
| hydroquinone | 6 | g |
| sodium carbonate (anhydrous) | 32 | g |
| potassium bromide | 2 | g |
| water to make | 1000 | ccs |

Table B

| Fog inhibitor /kg AgX | Fresh material | | | Incubated material | | |
|---|---|---|---|---|---|---|
| | fog | speed | $\gamma$ | fog | speed | $\gamma$ |
| control 1 | 0.16 | 100 | 1.59 | 0.90 | 142 | 0.68 |
| 0.1 mmole of compound 1 | 0.10 | 82 | 1.13 | 0.48 | 104 | 0.87 |
| control 2 | 0.13 | 100 | 1.45 | 1.03 | 84 | 0.78 |
| 0.1 mmole of compound 2 | 0.12 | 72 | 1.29 | 0.74 | 76 | 0.94 |
| control 3 | 0.12 | 100 | 1.70 | 1.32 | 44 | 1.24 |
| 2 mmole of compound 3 | 0.13 | 100 | 1.65 | 0.90 | 68 | 1.34 |

EXAMPLE 2

To several series of aliquot portions of a photographic silver bromoiodide gelatin emulsion (6 mole % of iodide) comprising per kg an amount of silver halide equivalent to 50 g of silver nitrate, one of the fog-inhibitors according to the invention was added as listed in the table C hereinafter. The emulsion portions were coated on a conventional support and dried.

The sensitometric values obtained after exposure and processing of a strip of the freshly prepared materials and of a strip of the materials which was stored for 5 days at 57° C. and 34% relative humidity are listed in the table C.

The values for the speed are relative values corresponding to density 0.1 above fog, the speed of the fresh materials comprising no fog inhibitor of the invention (controls) is given the value 100. The values given for the fog are absolute figures and the value for the $\gamma$ is the value of the gradation measured as described in example 1.

Development occurred at 20° C. for 5 min in a developing solution having the following composition:

| | | |
|---|---|---|
| water | 800 | ccs |
| p-monomethylaminophenol sulphate | 1.5 | g |
| sodium sulphite (anhydrous) | 50 | g |
| hydroquinone | 6 | g |
| sodium carbonate (anhydrous) | 32 | g |
| potassium bromide | 2 | g |
| water to make | 1000 | ccs |

Table C

| Fog inhibitor per mol AgX | Fresh material | | | Incubated material | | |
|---|---|---|---|---|---|---|
| | fog | speed | $\gamma$ | fog | speed | $\gamma$ |
| control 5 | 0.08 | 100 | 1.76 | 0.58 | 136 | 1.25 |
| 2 mmole of compound 11 | 0.06 | 63 | 1.65 | 0.23 | 100 | 1.60 |
| 0.2 mmole of compound 13 | 0.06 | 76 | 1.60 | 0.20 | 162 | 1.50 |
| 0.5 mmole of compound 9 | 0.06 | 82 | 1.50 | 0.29 | 228 | 1.35 |
| 0.4 mmole of compound 7 | 0.06 | 73 | 1.75 | 0.15 | 136 | 1.62 |
| control 6 | 0.10 | 100 | 1.90 | 0.62 | 180 | 1.28 |
| 1 mmole of compound 6 | 0.07 | 104 | 1.85 | 0.39 | 127 | 1.65 |
| 0.5 mmole of compound 5 | 0.06 | 93 | 1.70 | 0.12 | 152 | 1.65 |
| control 7 | 0.10 | 100 | 1.77 | 0.30 | 222 | 1.44 |
| 1 mmole of compound 22 | 0.10 | 100 | 1.57 | 0.10 | 94 | 1.34 |
| control 8 | 0.07 | 100 | 1.82 | 0.46 | 119 | 1.47 |
| 0.3 mmole of compound 17 | 0.06 | 76 | 1.72 | 0.16 | 119 | 1.55 |
| 0.1 mmole of compound 18 | 0.06 | 84 | 1.74 | 0.14 | 132 | 1.62 |
| control 9 | 0.08 | 100 | 1.64 | 0.42 | 222 | 1.44 |
| 0.5 mmole of compound 23 | 0.06 | 84 | 1.51 | 0.12 | 174 | 1.44 |
| 1 mmole of compound 25 | 0.08 | 72 | 1.46 | 0.12 | 119 | 1.30 |
| control 10 | 0.11 | 100 | 1.60 | 0.50 | 152 | 1.44 |
| 2 mmole of compound 10 | 0.10 | 56 | 1.76 | 0.25 | 111 | 1.65 |
| control 11 | 0.15 | 100 | 1.75 | 1.06 | 119 | 1.15 |
| 1 mmole of compound 12 | 0.12 | 78 | 1.50 | 0.23 | 132 | 1.52 |
| control 12 | 0.18 | 100 | 1.84 | 0.61 | 146 | 1.59 |
| 1 mmole of compound 20 | 0.10 | 90 | 1.82 | 0.20 | 136 | 1.61 |
| control 13 | 0.08 | 100 | 1.71 | 0.56 | 230 | 1.27 |
| 0.6 mmole of compound 4 | 0.08 | 82 | 1.65 | 0.20 | 136 | 1.54 |
| control 14 | 0.10 | 100 | 1.80 | 0.62 | 156 | 1.32 |
| 0.5 mmole of compound 8 | 0.06 | 66 | 1.60 | 0.15 | 100 | 1.50 |
| control 15 | 0.10 | 100 | 2.00 | 0.52 | 107 | 1.52 |
| 0.1 mmole of compound 14 | 0.09 | 88 | 1.79 | 0.24 | 100 | 1.49 |
| control 16 | 0.15 | 100 | 1.83 | 0.69 | 136 | 1.25 |
| 0.5 mmole of compound 15 | 0.11 | 104 | 1.78 | 0.24 | 222 | 1.64 |
| control 17 | 0.10 | 100 | 1.83 | 0.69 | 136 | 1.25 |
| 0.1 mmole of compound 16 | 0.08 | 82 | 1.74 | 0.26 | 132 | 1.61 |
| control 18 | 0.08 | 100 | 1.80 | 0.72 | 90 | 1.69 |
| 0.01 mmole of compound 19 | 0.08 | 74 | 1.70 | 0.38 | 119 | 1.66 |

EXAMPLE 3

This example shows the favourable effect of the fog-inhibitors according to the present invention when used in colour reversal material. In reversal processing increasing fog values after the first development stage result in reduced maximum density in the final image.

To each of the individual emulsion layers of a multicolour reversal material for processing at elevated temperature, 1.5 g of one of the fog-inhibitors listed in the following table D were added per mole of silver halide.

The total fog that is developed at 38° C. after conventional black-and-white development as used in colour reversal processing for 30 sec, 45 sec and 60 sec respectively is listed in the following table. The values given for the fog are % of silver formed with respect to the amount of silver halide coated.

Table D

| Fog inhibitor | Fog | | |
|---|---|---|---|
| | 90 sec | 45 sec | 60 sec |
| control | 21.4 | 30.0 | 40.7 |
| compound 20 | 19.3 | 21.9 | 32.1 |
| compound 15 | 18.6 | 22.4 | 34.9 |
| compound 5 | 17.0 | 21.9 | 32.0 |

The above results show that the compounds reduce fog formation in the black-and-white development stage of colour reversal processing. This results in increased maximum density for each of the colour separation images produced upon complete reversal processing at 38° C. of the materials. In the reversal processing black-and-white development took 90 sec at 38° C. and colour development 3 min at 38° C.

The results are listed in the table E.

Table E

| Fog inhibitor | $D_{max}$ yellow | magenta | cyan |
|---|---|---|---|
| control | 1.45 | 1.85 | 3.40 |
| compound 20 | 2.00 | 2.65 | 3.40 |
| compound 15 | 1.90 | 2.45 | 3.40 |
| compound 5 | 2.30 | 2.60 | above 3.50 |

We claim:

1. A photographic material comprising a support and at least one light-sensitive silver halide emulsion layer wherein the emulsion layer and/or a hydrophilic colloid layer in water-permeable relationship with the emulsion layer includes a compound in a stabilizing or fog-inhibiting amount corresponding to the following general formula:

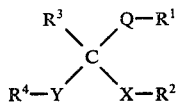

wherein:

Q is sulphur or selenium

X is sulphur, selenium or oxygen

Y is sulphur, selenium, oxygen or a single bond, $R^1$ stands for an alkyl group having no nitrogen containing substituents or an aryl group, $R^2$ represents the same groups as indicated for $R^1$, provided that only when X represents sulphur or selenium nitrogen containing substituents of alkyl are excluded, $R^3$ stands for hydrogen, carboxy in acid or salt form, an alkyl group or an aryl group, and $R^4$ stands for hydrogen provided Y represents a single bond, an alkyl group having no nitrogen containing substituents when Y represents sulphur or selenium and having no hydroxy substituents when Y represents a single bond and X as well as Q represent sulphur or selenium, or an aryl group, $R^3$ and $R^4$ may also form together an alkylene group provided Y is a single bond.

2. A photographic material according to claim 1, wherein each of $R^1$ and $R^2$ are carboxy alkyl and X represents sulphur or selenium.

3. A photographic material according to claim 1, wherein the compound is present in the silver halide emulsion layer.

4. A process of inhibiting fog formation during processing of a photographic light-sensitive silver halide material comprising a support coated with water-permeable colloid layers including a lightsensitive silver halide emulsion layer, which process comprises imagewise exposing the said material and developing the same with a silver halide developing composition in the presence of a compound which is present in the water-permeable colloid layers or the developing composition in a stabilizing or fog-inhibiting amount and corresponds to the following general formula:

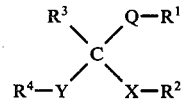

wherein:

Q is sulphur or selenium

X is sulphur, selenium or oxygen

Y is sulphur, selenium, oxygen or a single bond, $R^1$ stands for an alkyl group having no nitrogen containing substituents or an aryl group, $R^2$ represents the same groups as indicated for $R^1$, provided that only when X represents sulphur or selenium nitrogen containing substituents of alkyl are excluded, $R^3$ stands for hydrogen, carboxy in acid or salt form, an alkyl group or an aryl group, and $R^4$ stands for hydrogen provided Y represents a single bond, an alkyl group having no nitrogen containing substituents when Y represents sulphur or selenium and having no hydroxy substituents when Y represents a single bond and X as well as Q represent sulphur or selenium, or an aryl group, $R^3$ and $R^4$ may also form together an alkylene group provided Y is a single bond.

5. A process according to claim 4, wherein each of $R^1$ and $R^2$ are carboxy alkyl and X represents sulphur or selenium.

* * * * *